US009867393B2

(12) United States Patent
Borschke et al.

(10) Patent No.: US 9,867,393 B2
(45) Date of Patent: Jan. 16, 2018

(54) SYSTEM FOR MOIST TOBACCO EXTRACT COLLECTION AND ISOLATION

(71) Applicant: R.J. Reynolds Tobacco Company, Winston-Salem, NC (US)

(72) Inventors: August J. Borschke, Winston-Salem, NC (US); Michael F. Dube, Winston-Salem, NC (US); Paul A. Brinkley, Winston-Salem, NC (US); Anthony R. Gerardi, Winston-Salem, NC (US); Crystal D. Hege Byrd, Lexington, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 474 days.

(21) Appl. No.: 14/326,833

(22) Filed: Jul. 9, 2014

(65) Prior Publication Data

US 2014/0318555 A1 Oct. 30, 2014

Related U.S. Application Data

(63) Continuation of application No. 13/486,213, filed on Jun. 1, 2012, now Pat. No. 8,800,571.

(51) Int. Cl.

| | |
|---|---|
| ***A24B 9/00*** | (2006.01) |
| ***A24B 1/02*** | (2006.01) |
| ***A24B 3/12*** | (2006.01) |

(52) U.S. Cl.

CPC ..... *A24B 9/00* (2013.01); *A24B 1/02* (2013.01); *A24B 3/12* (2013.01)

(58) Field of Classification Search

CPC ..... A24B 1/02; A24B 3/10; A24B 3/12

See application file for complete search history.

(56) References Cited

U.S. PATENT DOCUMENTS

| | | | |
|---|---|---|---|
| 1,547,958 | A | 7/1925 | Ring |
| 2,082,289 | A | 11/1936 | Hodgin |

(Continued)

FOREIGN PATENT DOCUMENTS

| | | | |
|---|---|---|---|
| CA | 1026186 | | 2/1978 |
| CN | 102247003 | A * | 11/2011 |

OTHER PUBLICATIONS

International Search Report and Written Opinion for Int'l Application No. PCT/US2013/040068, dated Sep. 17, 2013.

*Primary Examiner* — Eric Yaary

(74) *Attorney, Agent, or Firm* — Brinks Gilson & Lione LLP

(57) ABSTRACT

A system for a tobacco curing barn is capable of collecting tobacco-derived moisture from tobacco while that tobacco is cured. The system incorporates a tobacco curing barn or other type of curing enclosure, such as bulk curing barn used for the flue-curing of tobacco. The curing barn is equipped with at least one reclamation element configured to condense and collect moisture released from tobacco cured within the barn. The reclamation element is disposed in proximity with the enclosure in a manner and location providing passage of moist air released from the tobacco across a surface of the reclamation element. The system also includes at least one storage container disposed in fluid communication with the reclamation element surface and configured to store moisture and moisture-borne material collected by the reclamation element. The resulting tobacco-derived components can be blended with other tobacco materials, such as is common practice during tobacco reordering.

19 Claims, 5 Drawing Sheets

(56) References Cited

U.S. PATENT DOCUMENTS

| | | | | |
|---|---|---|---|---|
| 2,134,843 | A | | 11/1938 | Rouse |
| 2,472,534 | A | | 6/1949 | Horne |
| 2,475,568 | A | | 7/1949 | Moore, Jr. |
| 3,110,326 | A | | 11/1963 | Hassler |
| 3,134,583 | A | | 5/1964 | Wilson |
| 3,244,445 | A | | 4/1966 | Wilson |
| 3,251,620 | A | | 5/1966 | Hassler |
| 3,503,137 | A | | 3/1970 | Wilson |
| 3,664,034 | A | | 5/1972 | Wilson |
| 3,669,429 | A | | 6/1972 | Dew |
| 3,937,227 | A | | 2/1976 | Azumano |
| 4,011,041 | A | | 3/1977 | Taylor |
| 4,021,928 | A | | 5/1977 | Johnson |
| 4,114,288 | A | | 9/1978 | Fowler |
| 4,192,323 | A | | 3/1980 | Horne |
| 4,206,554 | A | | 6/1980 | Fowler |
| 4,247,992 | A | | 2/1981 | MacGregor |
| 4,263,721 | A | | 4/1981 | Danford |
| 4,267,645 | A | | 5/1981 | Hill |
| 4,424,024 | A | | 1/1984 | Wilson et al. |
| 4,482,315 | A | * | 11/1984 | Day ..... A24B 1/02 110/233 |
| 4,499,911 | A | | 2/1985 | Johnson |
| 4,864,942 | A | * | 9/1989 | Fochtman ..... B09B 3/0091 110/226 |
| 5,119,571 | A | * | 6/1992 | Beasley ..... F26B 21/086 34/446 |
| 5,395,285 | A | * | 3/1995 | Milton ..... B05B 15/1222 454/52 |
| 5,685,710 | A | | 11/1997 | Martinez Sagrera et al. |
| 6,202,649 | B1 | | 3/2001 | Williams |
| 7,025,066 | B2 | | 4/2006 | Lawson et al. |
| 7,293,564 | B2 | | 11/2007 | Perfetti et al. |
| 7,404,406 | B2 | | 7/2008 | Peele |
| 7,650,892 | B1 | | 1/2010 | Groves et al. |
| 7,798,153 | B2 | | 9/2010 | Lawrence, Jr. |
| 8,151,804 | B2 | | 4/2012 | Williams |
| 2002/0088139 | A1 | * | 7/2002 | Dinh ..... A24B 1/02 34/467 |
| 2007/0003899 | A1 | | 1/2007 | Lipscomb et al. |
| 2008/0245377 | A1 | | 10/2008 | Marshall et al. |
| 2011/0220130 | A1 | | 9/2011 | Mua et al. |
| 2011/0259353 | A1 | | 10/2011 | Coleman, III et al. |

* cited by examiner

SYSTEM FOR MOIST TOBACCO EXTRACT COLLECTION AND ISOLATION

CROSS-REFERENCE TO RELATED APPLICATIONS

This application claims priority as a continuation of U.S. application Ser. No. 13/486,213, filed Jun. 1, 2012, by Borschke et al., which is incorporated by reference herein in its entirety.

TECHNICAL FIELD

The present invention relates to products made or derived from tobacco, or that otherwise incorporate tobacco, and are intended for human consumption. Of particular interest are systems and methods for obtaining or deriving ingredients or components from plants or portions of plants from the *Nicotiana* species.

BACKGROUND OF THE INVENTION

Cigarettes, cigars, and pipes are popular smoking articles that employ tobacco in various forms. Such smoking articles are used by heating or burning tobacco, and aerosol (e.g., smoke) may be inhaled by the smoker. Tobacco may also be enjoyed in a so-called "smokeless" form. Particularly popular smokeless tobacco products are employed by inserting some form of processed tobacco or tobacco-containing formulation into the mouth of the user. Various types of tobaccos are set forth in U.S. Pat. No. 7,025,066 to Lawson et al.; U.S. Pat. No. 7,798,153 to Lawrence, Jr.; and U.S. Patent Appl. Pub. Nos. 2008/0245377 to Marshall et al. and 2011/0259353 to Coleman III et al.; each of which is incorporated herein by reference. Various types of representative tobacco products and technologies associated therewith are documented and described in the background art set forth in U.S. Pat. Pub. Nos. 2011/0220130 to Mua et al. and 2011/0259353 to Coleman III et al.; each of which is incorporated herein by reference.

For the preparation of smokable and smokeless tobacco products, it is typical for harvested plants of the *Nicotiana* species to be subjected to a curing process. Descriptions of various types of curing processes for various types of tobaccos are set forth in Tobacco Production, Chemistry and Technology, Davis et al. (Eds.) (1999). Exemplary techniques and conditions for curing flue-cured tobacco are set forth in Peele et al., Rec. Adv. Job. Sci., 21, 81-123 (1995); Nestor et al., Beitrage Tabakforsch. Int., 20, 467-475 (2003) and U.S. Pat. No. 7,404,406 to Peele, which are incorporated herein by reference. Additionally, representative techniques and conditions for air curing tobacco are set forth in Roton et al., Beitrage Tabakforsch. Int., 21, 305-320 (2005) and Staaf et al., Beitrage Tabakforsch. Int., 21, 321-330 (2005), which are incorporated herein by reference. Furthermore, certain types of tobaccos can be subjected to alternative types of curing processes, such as those known as fire curing or sun curing. See, also, for example, certain other types of curing processes and modified curing processes of the type set forth in U.S. Pat. No. 7,293,564 to Perfetti et al.; U.S. Pat. No. 7,650,892 to Groves et al. and U.S. Pat. No. 8,151,804 to Williams, which are incorporated herein by reference. Preferably, harvested tobaccos that are cured are then aged.

During curing processes, tobaccos experience significant weight loss. That is, a significant amount of certain components naturally present in a tobacco when that tobacco is harvested are removed from that tobacco. For example, during curing, a significant amount of the moisture naturally present in a tobacco is removed from that tobacco and lost to the environment.

It would be desirable to provide a manner or method for collecting components naturally present in tobacco, and for using those components in the manufacture of tobacco products. In particular, it would be desirable to provide cured tobacco, and in addition, to collect and isolate many of the tobacco-derived components that are normally lost during tobacco curing operations. As such, it would be desirable to provide systems and methods for capturing and isolating natural tobacco components that normally are lost during tobacco curing processing steps (e.g., so that those components that are natural to tobacco can be reincorporated into or otherwise be recombined with tobacco materials that are processed during the manufacture of tobacco products). In addition, it would be desirable to reincorporate naturally occurring tobacco components, such as those that are removed from harvested tobacco during curing processes, into tobacco materials during tobacco processing operations associated with the preparation of tobacco products, rather than incorporating exogenous ingredients and processing aids into those tobacco materials.

BRIEF SUMMARY OF THE INVENTION

The present invention relates to the removal and collection of naturally occurring components of plants or portions of plants from the *Nicotiana* species. Of particular interest is the removal and collection of naturally occurring components of harvested tobacco plants or plant portions, such as occurs during tobacco curing process steps. As such, it is possible to provide from harvested tobacco a tobacco material that has been subjected to curing process steps (and hence can be considered to be cured tobacco); and it is also possible to collect from that harvested tobacco certain natural components of that harvested tobacco that would otherwise be lost to the surrounding environment during curing process steps. Thus, in one regard, the present invention relates to a process or method that involves collection of components natural to harvested tobacco during tobacco drying processes that can be considered to be curing processes. Additionally, in another regard, the present invention relates to equipment suitable for both curing harvested tobacco and collecting natural tobacco components that are removed from the tobacco and that would otherwise be lost during conventional tobacco curing conditions.

The processes and equipment of the present invention provide one skilled in the art of tobacco harvesting, processing and curing with a means for capturing moisture and moisture-borne components released from tobacco during curing. These components, natural to tobacco and naturally present in the harvested tobacco plant or plant portion, can be collected using reclamation elements, such as, for example, dehumidifier-style condenser coils. Of particular interest are modifications of processes associated with the flue-curing of tobacco and tobacco barns used in association with tobacco flue-curing. Thus, in accordance with the present invention, it is possible for obtain, for example, both flue-cured tobacco (e.g., cured tobacco lamina and stem) and isolated liquid components removed from that flue-cured tobacco during the curing process to which that tobacco was subjected.

Of particular interest is a system for a tobacco curing barn, where such system is capable of, or—more preferably is configured for—collecting tobacco-derived moisture and other compounds naturally present in tobacco from a tobacco while that tobacco is cured. The system incorporates a tobacco curing barn or other type of curing enclosure, such as bulk curing barn used for the flue-curing of tobacco. The curing barn is equipped with at least one reclamation element configured to condense and collect moisture released from tobacco cured within the barn. The reclamation element is disposed in proximity with the enclosure in a manner and location so as to provide for passage of moist air released from the tobacco from the inner region barn across a surface of the condenser element. The system also includes at least one storage container disposed in fluid communication with the reclamation element, and each container is configured to store moisture and moisture-borne material collected by each respective reclamation element.

The present invention provides for the collection and isolation of components naturally present within tobacco, or directly collected as a result of the processing of tobacco. The isolated tobacco-derived components have a wide variety of uses. Of particular interest is that they can be utilized, for example, by blending or otherwise incorporating those components into other forms of tobacco (e.g., processed tobaccos such as processed tobacco stems, tobacco strip and/or tobacco cut filler). Additionally, the isolated components can be used in carrying out tobacco reconstitution processes, tobacco expansion processes, processes involving steam treatment of tobacco, tobacco reordering, tobacco extraction of freshly harvested or cured tobacco to provide water-based tobacco extracts, or other processes that otherwise provide for moistening tobacco, extraction of components from tobacco, and the like.

Collected and isolated components of the present invention (e.g., high moisture content extracts, and in certain preferred instances, tobacco-derived components that are composed virtually entirely of water) can be used in various tobacco processing operations associated with the manufacture of tobacco products, as a result can be useful as natural components of tobacco products (e.g., in smoking articles such as cigarettes, and in smokeless products such as moist snuff). As such, for the manufacture of tobacco products, incorporation of ingredients that might be considered to be additives or otherwise exogenous (e.g., not derived directly from natural tobacco) can be minimized or virtually eliminated.

The present invention also relates to tobacco compositions (e.g. for use as components of smoking articles and smokeless tobacco products) incorporating tobacco material that comprises tobacco-derived components (and in particular, moisture and moisture-borne components) that having been reclaimed (or otherwise captured and isolated) during a tobacco curing process. In certain preferable aspects, those tobacco products are virtually absent of such types of ingredients that might be otherwise considered to be exogenous to natural tobacco.

DETAILED DESCRIPTION OF THE PREFERRED EMBODIMENTS

Figure 1A:
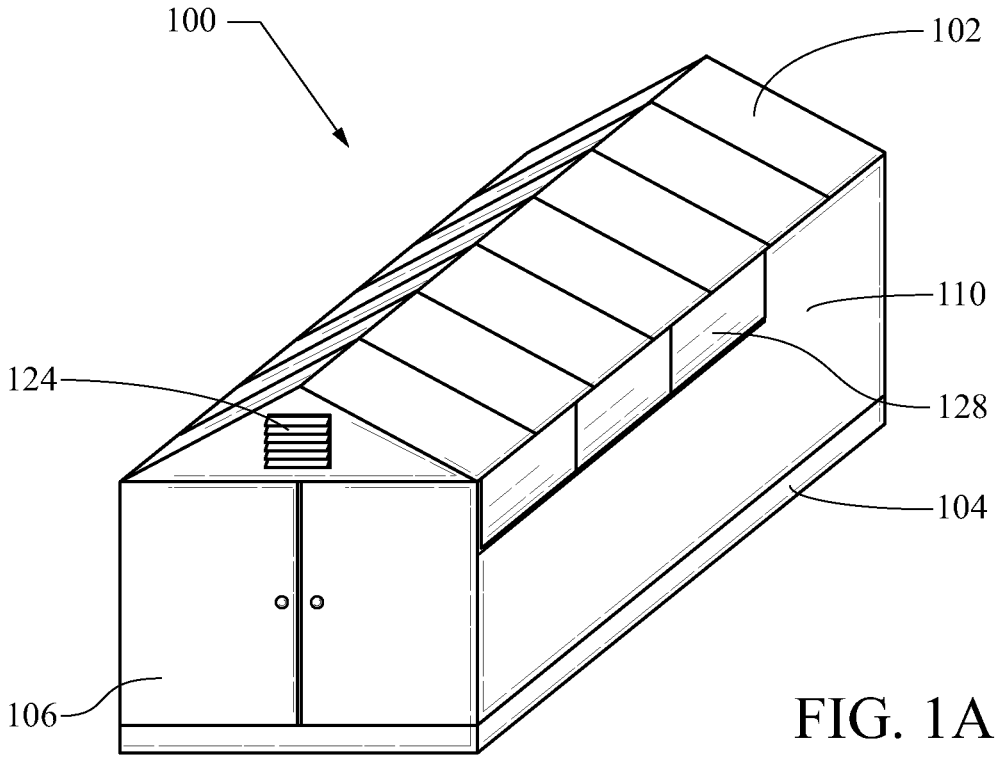
FIGS. 1A, 1B, and 1C show views of a tobacco curing barn including a moisture reclamation system embodiment.

Embodiments are described with reference to the drawings in which like elements are generally referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments of the present invention, such as—for example—conventional fabrication and assembly.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). The phrase "at least one" refers to both singular and plurality occurrences unless otherwise defined.

The plants or portions of plants from the *Nicotiana* species that are processed in accordance with the present invention can vary. Various types of tobaccos are set forth in U.S. Pat. No. 7,025,066 to Lawson et al.; U.S. Pat. No. 7,798,153 to Lawrence, Jr.; and U.S. Patent Appl. Pub. Nos. 2008/0245377 to Marshall et al. and 2011/0259353 to Coleman III et al.; each of which is incorporated herein by reference. Of particular interest are tobaccos that are subjected to the application of heat during curing, such as tobaccos that are subjected to so-called flue-curing process steps.

The manner by which tobaccos, such as so-called Virginia tobaccos, are grown, harvested and processed so as to provide flue-cured tobaccos is well known. See, for example, Garner, USDA Bulletin No. 143, 7-54 (1909); Darkis et al, Ind. Eng. Chem., 28, 1214-1223 (1936); Cooper et al., VPI Bull., 37(6), 3-28 (1939); Brown et al., Agric. Eng., 29(3), 109-111 (1948); Bacon et al., USDA Tech. Bulletin No. 1032 (1951); Darkis et al., Ind. Eng. Chem., 44, 284-291 (1952); Bacon et al., Ind. Eng. Chem., 44, 292-309 (1952); Johnson et al., Job. Sci., 4, 49-55 (1960); Johnson, Rec. Adv. Tob. Sci., Inag. Vol., 63-78 (1974); Hawks, Jr., Principles of Flue-Cured Tobacco Production, 2.sup.Ed. (1978); Curing Flue-Cured Tobacco in Canada, Publication 1312/E (1987); Suggs et al., Tob. Sci., 33, 86-90 (1989); Flue-Cured Tobacco Information 1993, N. C. Coop. Ext. Serv.; Peele et al., Rec. Adv. Tob. Sci., 21, 81-123 (1995); Nestor et al., Beitrage Tabakforsch. Int., 20, 467-475 (2003) and U.S. Pat. No. 7,404,406 to Peele; which are incorporated herein by reference.

A curing barn used to apply heat to tobacco and hence provide flue-cured tobaccos commonly is equipped with a heating source, such as an indirect heating source (e.g., an electrical heating unit, or a propane or diesel powered heat exchange unit). A common curing barn also is equipped with a fan for circulating air within the barn, and manual or automated temperature and humidity controls. Exemplary curing barns and methods for curing tobacco using those barns are of the type described in U.S. Pat. No. 1,547,958 to Ring; U.S. Pat. No. 2,082,289 to Hodgin; U.S. Pat. No. 2,134,843 to Rouse; U.S. Pat. No. 2,474,534 to Home; U.S. Pat. No. 2,475,568 to Moore, Jr.; U.S. Pat. No. 3,110,326 to Hassler; U.S. Pat. No. 3,134,583 to Wilson; U.S. Pat. No. 3,244,445 to Wilson; U.S. Pat. No. 3,251,620 to Hassler; U.S. Pat. No. 3,503,137 to Wilson; U.S. Pat. No. 3,664,034 to Wilson; U.S. Pat. No. 3,669,429 to Dew; U.S. Pat. No. 3,937,227 to Azumano; U.S. Pat. No. 4,011,041 to Taylor; U.S. Pat. No. 4,021,928 to Johnson; U.S. Pat. No. 4,114,288 to Fowler; U.S. Pat. No. 4,192,323 to Home; U.S. Pat. No. 4,206,554 to Fowler; U.S. Pat. No. 4,247,992 to MacGregor; U.S. Pat. No. 4,267,645 to Hill; U.S. Pat. No. 4,424,024 to Wilson et al. U.S. Pat. No. 4,499,911 to Johnson; U.S. Pat. No. 5,685,710 to Martinez Sagrera et al.; U.S. Pat. No. 6,202,649 to Williams; U.S. Pat. No. 7,293,564 to Perfetti et al. and U.S. Pat. No. 7,404,406 to Peele; and Canadian Patent No. 1,026,186; which are incorporated herein by reference. In North America, and particularly in the U.S.A., tobacco curing barns have been manufactured and supplied by various companies, including Long Manufacturing Inc., Taylor Manufacturing Company, Powell Manufacturing Company, Tharrington Industries, and DeCloet Ltd. Other curing barns are available throughout the world, and exemplary barns can be provided by Vencon-Varsos S.A. of Greece (e.g., tobacco curing systems marketed as Vento-bacco Curing Units). Tobacco flue-curing barns have been manufactured and operated in traditional manners for many years, and the design, manufacture and use of such barns will be readily apparent to those skilled in the art of tobacco curing.

Figure 1B:
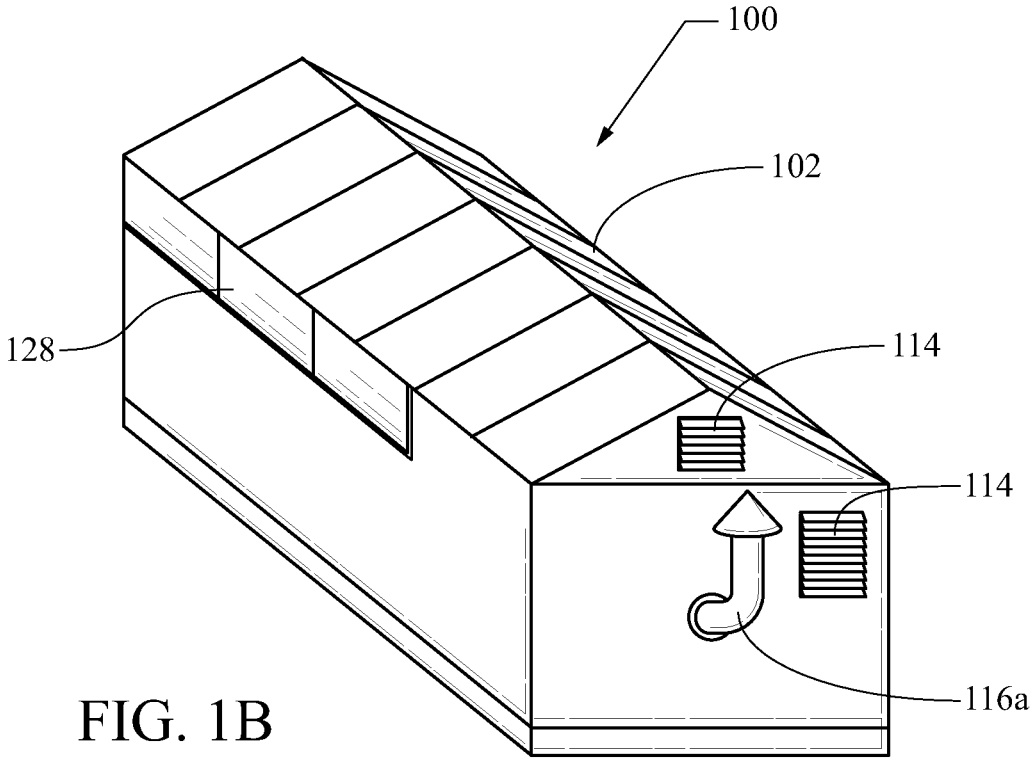
Figure 1C:
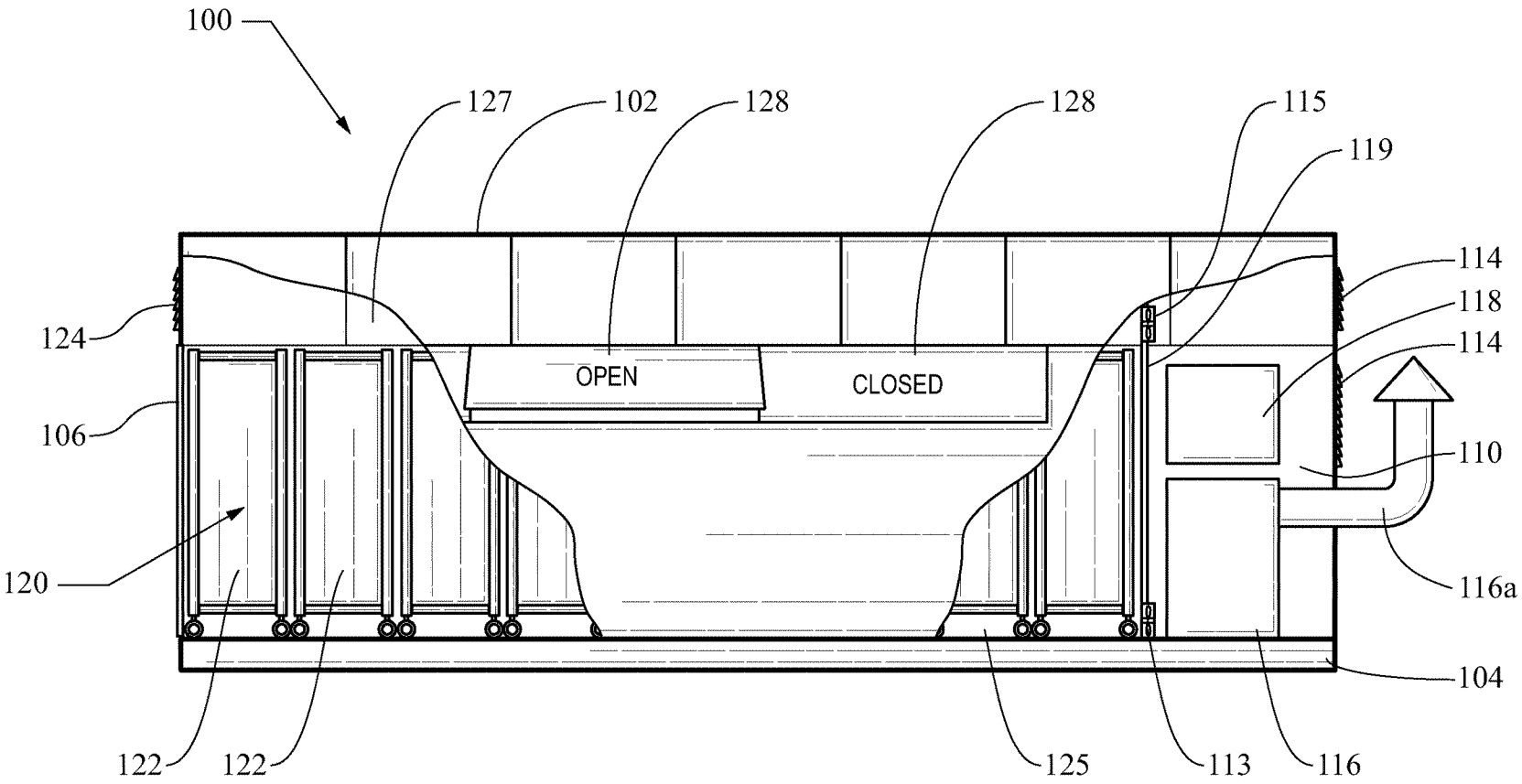
Figure 1D:
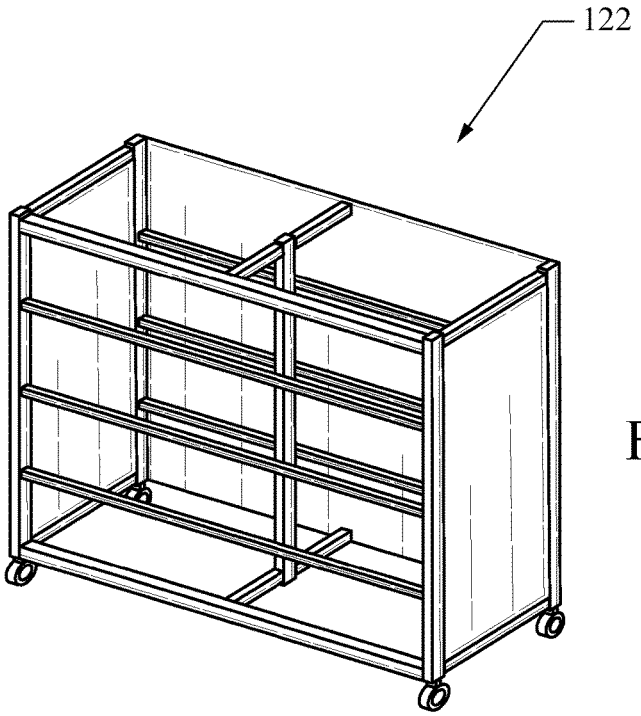
FIG. 1D shows an example of a rack configured for use in a barn (such as those shown in FIGS. 1A, 1B, and 1C)

Typically, a representative flue-curing barn 100 includes a roof 104, four walls and a foundation 104, as shown diagrammatically in FIGS. 1A-1D. FIGS. 1A and 1B show front and rear perspective views, respectively, of one example of a tobacco bulk curing barn 100, while FIG. 1C shows a side view with an exterior wall portion removed for illustrative purposes to show elements of the barn interior. Such a barn 100 typically includes a furnace area 110 at one end (which may be partially or wholly external to the four walls in some barns) and a tobacco curing region 120 adjacent the furnace area 110, occupying at least a portion of the rest of the barn interior. In a typical bulk curing barn, the furnace area 110 and tobacco curing region 120 are separated from one another by a wall 119. Such a barn 100 often includes doors 106 at the curing region 120 end of the barn in order to allow loading of tobacco to (and unloading of tobacco from) that barn, commonly in racks 122 that are packed with tobacco leaves in a particular manner. One example of a rack structure 122 is shown in FIG. 1D. In certain preferred embodiments, bulk tobacco curing barns are equipped with boxes rather than or in addition to racks.

Generally, the barn 100 includes an air intake damper 114 near its furnace end, and an exhaust damper 124 near doors of its curing region end. Typically, the tobacco to be cured is contained in the racks and/or boxes 122. The furnace area 110 of the barn 100 includes a heat source 116 (e.g., a burner that is fueled by a suitable fuel, such as liquid propane gas (LPG) or fuel oil), a heat exchange unit 118 (unless fire-curing is being used, although a heat exchanger may be used to pre-heat incoming air in certain fire-curing systems), and one or more air-directing means, embodied here as fans 113, 115. In use, heated air in the region near the heat exchanger 118 is forced in a chosen direction by the fan(s), and is forced to flow into the tobacco curing region 120 of the barn via air flow passages. During "indirect heat curing" the air passing through the heat exchanger 118 is heated, but may be kept separate from the exhaust byproducts of whatever is being burned to generate the heat. A chimney or other exhaust vent or outlet **116*a*** may be provided to exhaust certain combustion by-products from the heat-generation device (e.g., furnace).

Depending on the barn's configuration, the heated air may be directed through lower air flow passage(s) 125, passing up through the tobacco curing region 120. Thereafter, some of the heated air (now including moisture released from the air-heated tobacco, which may include—for example—moisture in the form of water, other moisture and/or moisture-borne material) may be exhausted out through a damper (e.g., exhaust damper 124), and/or side vent(s) 128, while another portion of the heated air may be returned back to the furnace area 110 via upper air flow passage(s) 127. A series of nozzles that are connected to a water source may be provided to aid in humidity control. In other embodiments, heated air may travel from the furnace area 110 through upper air flow passage(s) 127 and across the tobacco before being returned and/or exhausted.

The conditions of temperature to which the tobacco is exposed during curing can vary. The time frame over which curing of the tobacco occurs also can vary. For the flue-curing of Virginia tobaccos, the temperature to which the tobacco is exposed typically is in the range of about 35° C. to about 75° C.; and the time over which the tobacco is exposed to those elevated temperatures usually is at least about 120 hours, but often may be less than about 200 hours. Curing temperatures reported herein are air temperatures that are representative of the average air temperature within the curing barn during curing process steps. Average air temperatures can be taken at one or more points or locations within the curing barn that give an accurate indication of the temperature that the tobacco experiences during curing steps. Typically, Virginia tobacco first is subjected to a yellowing treatment step whereby the tobacco is heated at about 35° C. to about 40° C. for about 24 to about 72 hours, often about 36 to about 60 hours; however, if desired, the yellowing step can be shortened. See, for example, U.S. Pat. No. 8,151,804 to Williams, which is incorporated herein by reference. The tobacco then is subjected to a leaf drying treatment step whereby it is heated, for example, at about 40° C. to about 57° C. for about 48 hours; after which it is subjected to a midrib (i.e., stem) drying treatment step whereby it is heated, for example, at about 57° C. to about 75° C. for about 48 hours.

Thus, tobacco may be cured for a total period of about 5 days to about 8 days, often about 6 days to about 7 days. Temperatures to which the tobacco is exposed during cure typically will not exceed about 90° C., frequently will not exceed about 85° C., and preferably will not exceed about 80° C. Exposing Virginia tobacco to temperatures above about 70° C. to about 75° C. during curing may not be desirable, as exposure of the tobacco to exceedingly high temperatures, even for short periods of time, can have the effect of decreasing the quality of the cured tobacco. Typically, some ambient air preferably is introduced into the barn during the yellowing stage, significantly more ambient air preferably is introduced into the barn during the leaf drying stage, and heated air preferably is recirculated within the barn during midrib drying stage. The relative humidity within the barn during curing varies, and is observed to change during curing. Typically, a relative humidity of about 85 percent is maintained within the curing barn during the yellowing stage, but then is observed and/or controlled to decrease steadily during leaf drying and midrib drying stages.

After the tobacco is exposed to curing conditions, the use of heating is stopped. Typically, the fresh air dampers/vents as well as the doors of the barn are opened in order to allow contact of ambient air with that tobacco. As such, moisture within the ambient air is allowed to moisten the tobacco; and the very dry freshly cured tobacco is rendered less brittle. Those of skill in the art will appreciate that tobacco curing of this type is generally conducted in locations/climates with high relative humidity, which is exploited for this moistening effect. Additionally, the freshly cured tobacco can be moistened by spraying tobacco with a spray or mist of water. If desired, the tobacco can be moistened using some of the high moisture-containing liquid that is collected in accordance with the present invention. In such a circumstance, no significant moisture that is not endogenous to the cured tobacco is applied to that tobacco. The cooled tobacco then is taken down, and the tobacco is removed from the curing barn. Most preferably, the resulting cured tobacco is of a type and quality that is at least comparable to flue cured tobacco that is obtained using conventional flue curing techniques.

Figure 2:
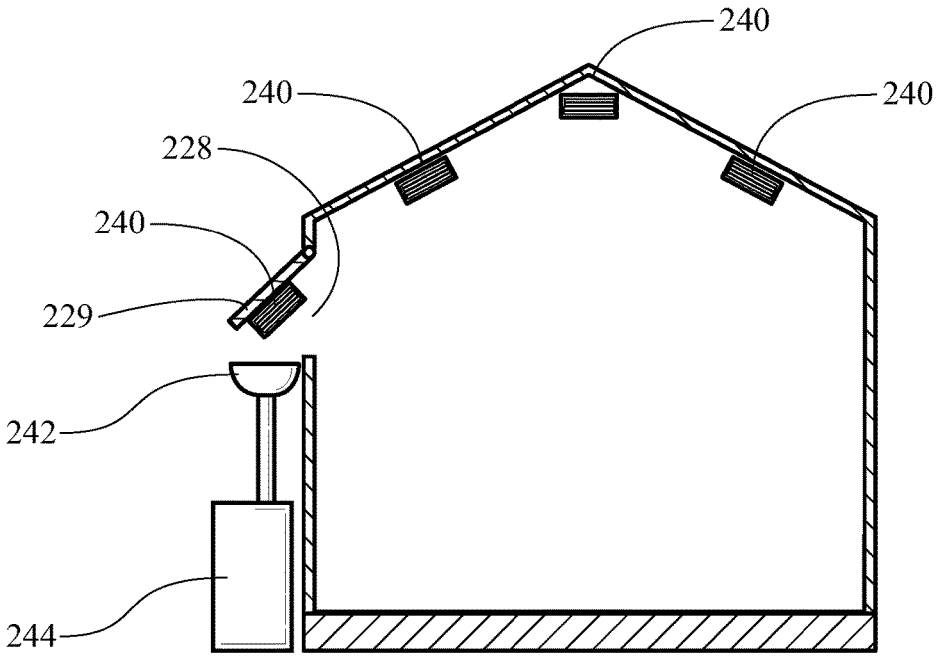
FIG. 2 shows a transverse section view of a curing barn including some examples of mounting locations for moisture capture/reclamation system elements.

Referring to FIG. 2, a curing barn is diagrammatically shown in partial transverse section view as incorporating a system of the present invention. It is well-known in the art to control humidity of the air in a curing barn. For example, U.S. Pat. No. 7,293,564 to Perfetti et al. describes techniques for dehumidifying air that is to be heated and passed over the tobacco in a curing barn.

In some embodiments, a curing barn 200 may be provided including at least one reclamation element or unit 240 that may be embodied as a vapor condensation and/or dehumidifier element. Specifically, a reclamation unit 240 typically includes at least one surface that is configured to be cooled to a moisture-condensing relative temperature and/or that is otherwise configured to promote condensation thereupon of moisture/liquid and/or moisture-carried components released from tobacco within the curing barn, thus resulting in isolation of certain natural components derived from the processed tobacco. The surface preferably may be configured to direct and capture the vapor and/or vapor-carried components into a container 244. That is, a reclamation element preferably is configured to condense and collect moisture released from curing tobacco, and is disposed in proximity with the curing region in a manner and location providing for passage of moist air from the enclosure across a surface of the condenser element, thus allowing collection of moisture and moisture-borne components. Preferably, the storage container is configured in fluid communication with the reclamation element, and is configured to store moisture and moisture-borne material from the reclamation element.

In FIG. 2, a plurality of reclamation units 240 is diagrammatically shown in a tobacco curing barn 200. A reclamation unit may include and/or be embodied as a cooling/condenser coil through which a refrigerant circulates, thus providing a surface temperature lower than the temperature of the heated atmosphere from the barn 200. The condenser 240 may be controlled such that its surface temperature does not promote condensation, to any significant extent, of ambient humidity in the atmosphere around the barn 200. In other embodiments, exemplary reclamation units may include or incorporate polymeric, metallic, or bimetallic surfaces configured as known in the materials sciences arts from materials known to promote and/or maintain a surface temperature below ambient/surrounding air temperature, so as to promote the condensation of airborne moisture thereupon.

Reclamation units may be disposed in one or more locations in a curing barn 200, illustrated in FIG. 2 as a diagrammatically simplified transverse section view of a tobacco curing barn 200. As shown in FIG. 2, at least one reclamation unit 240 may be provided on the undersides of vent dampers 229 of vents 228. A collection trough 242 is shown below the reclamation units 240. The collection trough 242 preferably is configured to capture condensed moisture, which moisture has been derived from the tobacco that is subjected to heat and which moisture may also incorporate certain other components that have been liberated from the tobacco in the barn 200. Each of the various reclamation units most preferably is configured in fluid communication with a container 244, configured to collect and store the moisture and moisture-borne components. The moisture and any organic, inorganic, and other components carried in it may be stored in the container(s) 244 or transferred to a different location for storage and/or further treatment. Other locations for reclamation units may include one or more of, for example, an interior or external wall or ceiling/roof surface; in and/or on racks, boxes, or other tobacco-supporting structures; one or more venting openings; along an air-flow passageway for air return to a heating region of the barn; and/or any other location in, on, or within the barn where it may be possible to condense or otherwise capture moisture and airborne materials released from tobacco during curing. The reclamation units may be partially or wholly within or external of the barn, including each (or both) of the curing area and the heating area.

Figure 3:
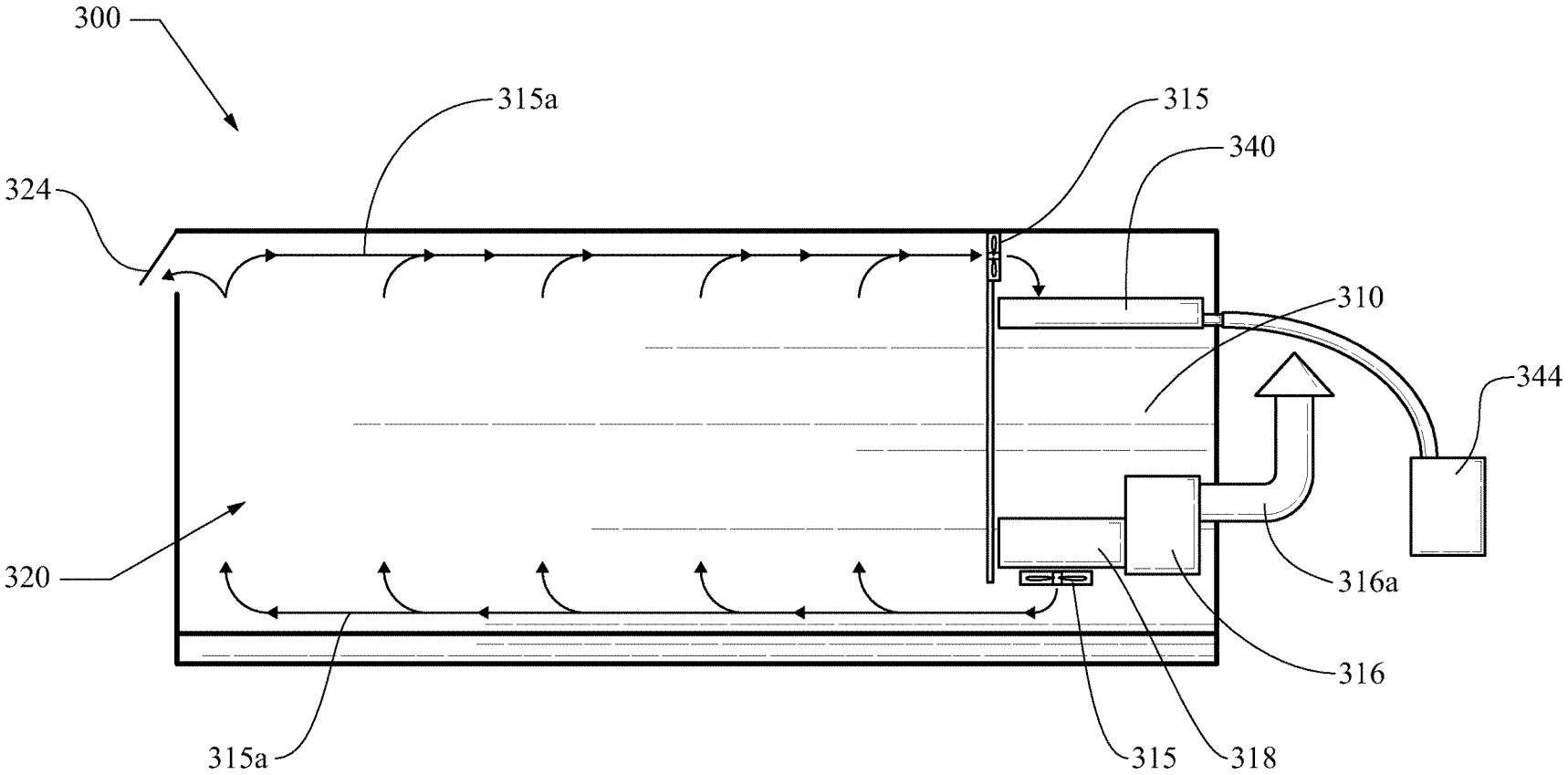
FIG. 3 shows a diagrammatically simplified view of a tobacco barn including a moisture reclamation system embodiment.

FIG. 3 shows a diagrammatically simplified view of a tobacco bulk curing barn 300 constructed much like the barn shown in FIG. 1C. The barn 300 includes a tobacco curing region 320 configured to hold racks and/or boxes of tobacco to be cured (not shown). It also includes a furnace area 310, which is configured to house a furnace or other heat source 316, a heat exchanger 315 (optional), and fans 315. As shown, the furnace 316 generates heat, which can either directly heat air to be blown directly into the curing region 320, or which can indirectly heat air via a heat exchanger 315, over which air flows and is directed into the curing region by fans 315.

After passing through the curing region 320 and over the tobacco therein, the air (flow of which is indicated by arrows 315*a*) travels back into the furnace area 310, although some may optionally be vented out (e.g., via vent/damper 324, of which a plurality may be provided). This air will generally include moisture and moisture-borne components released from the tobacco. In the present embodiment, the returning air passes across a reclamation unit 340, which may be embodied, for example, as a condenser unit made of a metallic and/or polymeric tubing through which refrigerant is circulated to lower its surface temperature and promote condensation of liquid from the air. The moisture and moisture-borne components may be captured by the reclamation unit 340 and directed into a holding container 344, while the air may be vented out and/or recirculated. It may be advantageous to separately capture and store different containers of liquid/captured moisture from different stages of curing, as different components may be liberated from the cured tobacco at different temperatures, and/or at different stages of the particular chemical composition of the tobacco leaves being cured.

As such, we have disclosed a system for curing tobacco and for collecting tobacco-derived moisture from tobacco while that tobacco is cured. The system may include a tobacco curing enclosure and at least one reclamation element configured to condense and collect moisture released from tobacco cured within the enclosure. where each reclamation element is disposed in proximity with the enclosure in a manner and location providing for passage of moist air released from the tobacco from the enclosure across a surface of each such condenser element. The system may also include at least one storage container disposed in fluid communication with each reclamation element, the container being configured to store moisture and moisture-borne material collected from each reclamation element. A heater to heat the tobacco and drive off moisture therefrom may be provided. An air-directing means such as, for example, one or more fans may also be provided to circulate and/or drive air along a desired airflow path. In certain embodiments, the airflow path crosses over at least one reclamation element, which preferably is configured to be (and indeed is) cooled to a moisture-condensing temperature.

In another aspect, we have disclosed a tobacco curing barn that includes a region to position harvested tobacco leave to be cured, a heat exchange unit to provide heat to cure the tobacco, a fan to circulate heated air within the barn, and a water reclamation system, where the water reclamation system includes at least one reclamation element configured to condense and collect moisture released from the harvested tobacco during curing, at least one container, and a path of fluid communication for moisture and moisture-borne material from each reclamation element to the at least one container. The reclamation element may include a cooling element and may be disposed within or immediately adjacent the barn, and particularly in or near a vent opening of the barn. The heating unit may include a furnace, and one or more reclamation units may be disposed adjacent the furnace. The barn may include a heating area separated from the curing area, and one or more reclamation elements may be disposed in one or both areas.

In certain embodiments, it may be useful to provide sensors for monitoring air moisture, temperature, and volume collected by the reclamation unit. Data from the sensors may be used for manually or automatically (via intermediate controls that will be apparent to those skilled in the art) effecting changes in one or more of the furnace (e.g., increased or decreased heat), fans (changing rate of air flow), vent states (e.g., opening or closing one or more vents to predetermined positions), and/or other relevant conditions might be controlled or moderated during tobacco curing process steps.

The tobacco components that are collected and isolated during the curing process steps of the present invention typically have relatively high moisture contents. Representative tobacco components that are collected in accordance with the present invention typically comprise at least about 95 weight percent water, often at least about 98 weight percent water, and frequently at least about 99 weight percent water. For representative tobacco components that are collected in accordance with the present invention, the amount of water that can be attributed to water naturally present in the harvested tobacco typically is at least about 90 weight percent, often at least about 95 percent, and frequently at least about 98 percent, based on the total amount of water that is collected; it being understood that a portion of that water might be attributed to water that is condensed from the atmosphere. Thus, for highly preferred embodiments, virtually of the moisture that is collected in accordance with the present invention can be attributed to moisture that was naturally present in the harvested tobacco from which that moisture is derived.

In addition to large amounts of water, the condensed tobacco extracts that are collected and isolated in accordance with the present invention may include (e.g., in solution, suspension or otherwise) other components that are naturally present in tobacco and are derived as a result of the process steps of the present invention. Representative organic tobacco components that may be collected and isolated include solanone, megastigmatrienone, nicotine, 2-butanol, isobutyl alcohol, phenethyl alcohol, hyroxy isovaleric acid, 2-hexanone, norsolanadione, 1,2 benzene dicarboxylic acid, vanillin, acetovanillone, and other volatile and semi-volatile types of components that are derived from harvested tobacco during the curing conditions experienced by that tobacco. Typically, representative collected tobacco components within the condensed tobacco extracts comprise water in an amount of at least about 98 weight percent, and often at least about 99 weight percent; and other components (such as the combined amounts of the organic tobacco components of the type previously described) in an amount of less than about 2 weight percent, and often less than about 1 weight percent.

The manner by which organic components can be collected can vary. In one embodiment, the organic components and vaporized water can be passed through certain organic chemical collection units prior to collection of that vaporized water or prior to venting that vaporized water from the tobacco curing barn. For example, the vaporized materials can be passed through filtration units (e.g., HVAC filters) or large columns or tubes that have been coated or otherwise surface treated with suitable sorbents, so as to trap organic components. Exemplary air sampling tubes are available commercially under the tradename Tenax from Buchem B.V., and suitable collection devices available from sources such as SKC Inc. and Scientific Instrument Services, Inc. Exemplary collection materials for airborne organic materials are of the types available under the tradenames Anasorb from SKC Inc., Chromosorb from Manville Corp., Porapak from Waters Associates, Inc., Osorb from Osorb Materials, Inc. and XAD from The Dow Chemical Company. The tobacco-derived organic tobacco materials then can be separated from the collection materials and isolated, using known types of chemical isolation techniques. Examples of extraction and/or isolation may include selective filtration, organic and/or inorganic extraction protocols, filtration, chromatography, including combinations of these or other existing and/or future-developed methods and materials).

The captured moisture (as well as the other components liberated from the tobacco during curing) has various uses. Selected components may be extracted from the isolated components using means known in the tobacco-processing and/or chemical arts. For example, the isolated components can be subjected to distillation treatment, fractional distillation, liquid-liquid extraction (e.g., partitioning organic compounds from water using a non-polar solvent, such as hexane or methylene chloride), column treated using exchange resins, or the like. As such, the isolated components can be purified, or certain of the isolated components can be further separated and isolated from one another. In such a manner, for example, certain or all of the collected organic components can be separated from the water that is collected during curing. The collected and isolated organic compounds can be used as natural, tobacco-derived flavoring agents for tobacco products.

Certain components released with and/or within moisture from tobacco during curing may be collected and isolated at certain select phases of curing process. For example, certain organic components can be collected in isolated only at early in the curing process, at intermediate stages of the curing process or at later stages of the curing process.

Certain components within tobacco-derived moisture can be collected and subjected to reclamation, separation or isolation processes, such as is provided by chromatography, fractional distillation, evaporation, crystallization, solvent separation, or the like. As such, isolated tobacco-derived components can be further isolated in a more concentrated or even purified forms.

The moisture containing tobacco materials that are isolated have a wide variety of uses. Portions of those tobacco materials can be recombined with the cured tobacco materials from which they were derived, or those tobacco materials can be blended with, or used for the processing of, certain other tobacco materials or blends of tobacco materials. Of particular interest are those tobacco materials that are used as sources of aqueous materials in situations that would otherwise use water as an added ingredient. In one regard, isolated moisture containing tobacco materials are useful as sources of steam, such as for example, in tobacco expansion processes (e.g., so-called dry ice expanded tobacco, or DIET, expansion processes) or in tobacco denicotinization processes. In another regard, isolated moisture containing tobacco materials can be used as extraction agents or processing aids for the preparation of reconstituted tobacco materials (e.g., for the preparation of reconstituted tobacco materials manufactured using so-called papermaking or band cast reconstitution processes). The moisture containing tobacco materials also are useful as sources of moisture when tobacco is treated during so-called reordering processing steps. The moisture containing tobacco materials also can be used as carriers or co-solvents for casing and/or top dressing components that are added to tobacco (e.g., formulations that are added to tobacco strip or cut filler). The moisture containing tobacco materials also can be used as a source of tobacco-derived moisture for moist forms of smokeless tobacco (e.g., moist snuff).

In certain instances, depending upon factors such as the overall composition of the tobacco-derived components that are collected, the tobacco materials with which those components are combined can exhibit desirable modifications to the colors, aromas, flavors, and/or other characteristics of those tobacco. Most preferably, the tobacco materials with which those components are combined do not exhibit properties that dissonant to the overall enjoyment of that tobacco by consumers of tobacco products manufactured using that tobacco.

Aspects of the present invention are more fully illustrated by the following examples, which are set forth to illustrate certain aspects of the present invention and are not to be construed as limiting thereof. Unless otherwise noted, all parts and percentages are by weight.

Example 1

Figure 4:
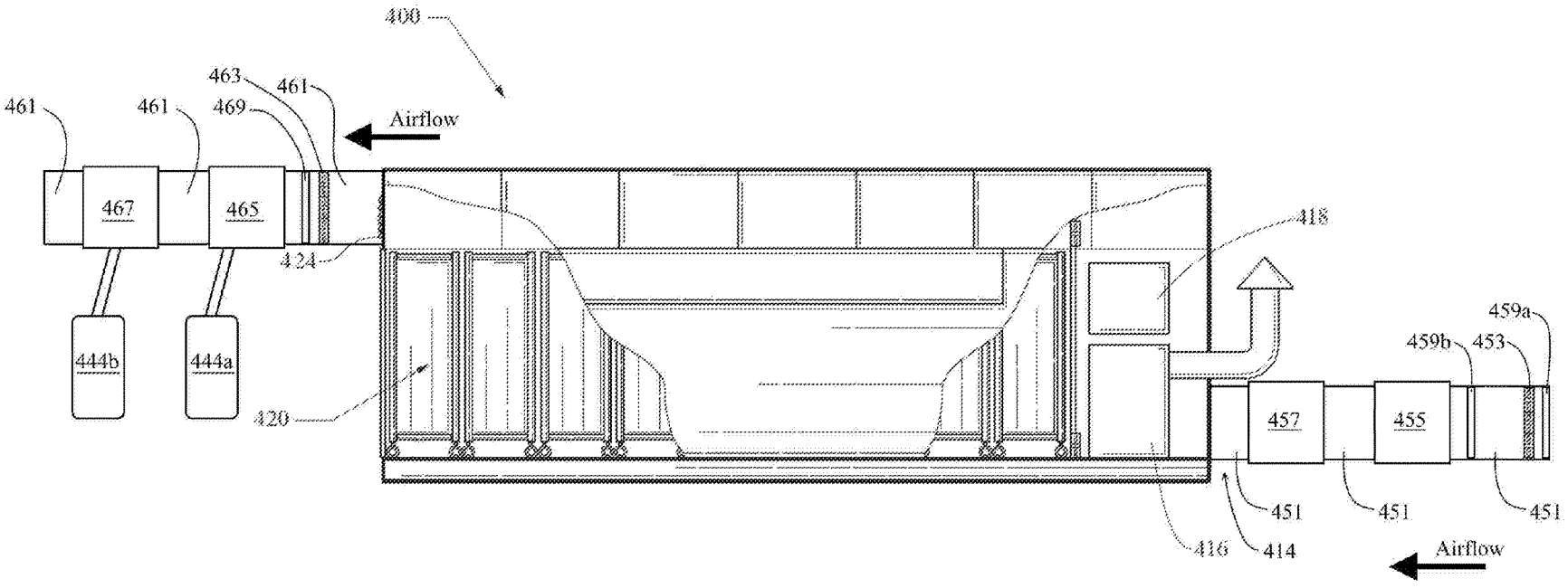
FIG. 4 shows another diagrammatically simplified view of a tobacco barn including a moisture reclamation system embodiment.

A tobacco curing barn known as a "bulk barn" is provided, illustrated generically/diagrammatically and not-to-scale as a barn 400 in FIG. 4. An exemplary bulk barn is a curing barn designed to flue-cure Virginia types of tobacco. One such barn is available as Decloet Rack Kiln from Decloet Ltd., Tillsonburg Ontario, Canada. The barn 400 is equipped with a heating system 416/418 that can be controlled during the curing process, and with a fan system in order that air can be drawn into the barn, air can be circulated within the barn, and moist air can be exhausted from the barn. Into the barn is placed approximately 18,000 pounds of freshly harvested Virginia tobacco leaf that has been harvested by priming tobacco from a tobacco field using traditional harvesting techniques. The Virginia tobacco that has been harvested has been grown using traditional growing techniques.

The tobacco is subjected to conventional flue-curing process conditions. That is, the tobacco within the barn is subjected to yellowing, leaf drying, and stem drying conditions that are of the type traditionally used by farmers when curing tobacco to yield flue-cured tobacco. That is, the tobacco in the barn 400 is heated using a heat exchange unit 418 in order to provide flue-cured tobacco that has been dried to a moisture content of about 15 percent, or less. As such, the initial approximately 18,000 pounds of tobacco yields roughly 2,700 pounds of cured tobacco, and roughly 15,300 pounds of tobacco extractables (principally in the form of extracted water that was naturally present within the harvested tobacco) is removed from that tobacco during the flue-curing process.

The air inlet region 414 of the barn is equipped with duct work 451 (e.g., conventional aluminum duct work used for conventional heating ventilation air conditioning (HVAC) applications) in order to provide an air inlet system that provides for dry air (i.e., air having a very low moisture content) to be introduced into the barn. This may help ensure that substantially all collected moisture is derived from the tobacco being cured.

An optional mesh screen or filter 459*a* (e.g., a convention type of air filter that is used for HVAC applications) may be positioned at the extreme upstream end of the duct work, and the screen or filter used to limit or prevent the introduction of undesirable solid materials into the air inlet system.

The air inlet system is further equipped with a fan or other type of suitable device 453 that is used to draw ambient air into the air inlet system. Representative fans are those centrifugal or squirrel cage types of fans; and representative types of fans are available as Aero Series 39MW30 from Carrier Corporation, Farmington, Conn. Typically, the fan is operated so as to provide movement of air through the air inlet system at a rate of about 7500 CFM to about 15,000 CFM (at 4 inch water column (wc) static pressure). As an example, air is drawn through the duct work at a rate of about 15,000 CFM (at 4 inch wc static pressure). As such, for ambient air at common relative humidity, the incoming moist ambient air introduces about 1,100 to about 1,200 pounds of water per hour into the duct work.

Downstream from the fan is positioned an optional mesh screen or filter 459*b*. Such screen or filter is generally of the type previously described. If desired, a screen or filter can be positioned on each side of the fan. If desired, a single screen or filter can be positioned upstream from the fan, or a single screen or filter can be positioned downstream from the fan. Most preferably, at least one screen or filter employed.

Within the duct work downstream from the fan (but upstream from the barn and positioned outside of the barn) is positioned at least one cooling coil 455, or other means for removing moisture from the ambient air that is passing through the duct work to the air inlet region of the barn. For example, a cooling coil available as Aero Series 39MW30 Direct Expansion Cooling Coil from Carrier Corporation can be positioned within the duct work. Such cooling coil is operated so that, for example, at least about 600 pounds of water can be removed per hour from an ambient airstream of about 15,000 CFM. The water condensed by the cooling coil can be removed from the air inlet system through a drain, collected in a container, or the like (not shown).

The airstream that has had a portion of its moisture removed then is introduced into a secondary drying system.

For example, the airstream is passed through a dehumidifying type of device 457, such as a Munters Honeycomb Dessicant Wheel DeHumidifier Model DryCool ERV-1440 that is obtained from Munters Corporation. As such, about 500 pounds per hour of water can be removed from that airstream. As such, the airstream that exits the air inlet region of the secondary drying system is very dry. That dry air then is directed through duct work 451 into the air inlet region of the barn.

The dry air that enters the air inlet region of the barn (i.e., in the curing chamber region 420 of the barn) typically has an airflow rate that is somewhat reduced relative to that of the airflow that enters the air inlet system. For example, the air that enters the air inlet region of the barn can have an airflow rate of about 12,300 CFM (for an initial airflow rate of 15,000 CFM that enters the air inlet system). In addition, greater than 99 percent of the water that was present in the ambient air entering the air inlet system is removed from that ambient air. Thus, given that the inlet air is very dry, virtually all of the water and other tobacco extractables that are collected using the liquid recovery system is that has been removed from the tobacco during the curing process.

Moisture and other extractables derived from the harvested tobacco during curing exits the curing barn through a port, window, or other type of exit region 424, which acts as an exhaust system or region. The exhaust system of the barn is equipped with duct work 461; and this duct work is located outside of the barn. The duct work is equipped with a filter 469 (e.g., a filter that can be characterized as a filter that is flat, bag-type, cartridge or high efficiency particulate (HEPA)).

The moist air exiting the barn through the duct work then passes through a direct expansion type of cooling coil 465 of a type operating in a traditional manner so as to provide for condensation of vapor in the surrounding atmosphere; and as such about 2100 pounds per hour of liquid tobacco extract can be condensed and collected.

A booster fan 463, such as an Aero Series 39MW30 from Carrier Corporation, is located near the extreme exit region of the duct work, and is employed in order to assist in removing the resulting heated air exiting the barn from the duct work. The moist air exiting the barn through the duct work 461 then passes through a cooling coil 465 of Aero Series 39MW30 Direct Expansion cooling Coil such about 2100 pounds per hour of liquid tobacco extract can be condensed and collected. Then, the moist air is passed through a dehumidifier 467, such as a Munters Honeycomb Dessicant Wheel DeHumidifier Model DryCool ERV-1440. As such, an additional 425 pounds per hour of liquid tobacco extract can be condensed and collected (e.g., in containers 444*a*/444*b*, which may be constructed like container 344 of FIG. 3). The air exiting the barn then is exhausted to the environment. The collected liquid tobacco extract samples then are combined.

Example 2

A tobacco curing barn known as a "bulk barn" is provided. One such barn is available as Decloet Rack Kiln from Decloet Ltd., Tillsonburg Ontario, Canada. The barn is equipped with a heating system that can be controlled during the curing process, and with a fan system in order that air can be drawn into the barn, air can be circulated within the barn, and moist air can be exhausted from the barn. Into the barn is placed approximately 18,000 pounds of freshly harvested Virginia tobacco leaf that has been harvested by priming tobacco from a tobacco field using traditional harvesting techniques. The Virginia tobacco that has been harvested has been grown using traditional growing techniques.

The tobacco is subjected to conventional flue-curing process conditions. That is, the tobacco in the barn is subjected to yellowing, leaf drying, and stem drying conditions that are of the type traditionally used by farmers when curing tobacco to yield flue-cured tobacco. That is, the tobacco in the barn is heated using a heat exchange unit in order to provide flue-cured tobacco that has been dried to a moisture content of about 15 percent, or less. As such, the initial approximately 18,000 pounds of tobacco yields roughly 2,500 pounds of cured tobacco, and over 15,000 pounds of tobacco extractables (principally in the form of extracted water) is removed from that tobacco during the flue-curing process.

The air inlet region of the barn is equipped with duct work (e.g., conventional aluminum duct work used for conventional HVAC applications) in order to provide an air inlet system that provides for dry air (i.e., air having a very low moisture content) to be introduced into the barn.

At the extreme upstream end of the duct work is positioned an optional mesh screen or filter (e.g., a convention type of air filter that is used for HVAC applications), and the screen or filter is used to limit or prevent the introduction undesirable solid materials into the air inlet system.

The air inlet system is further equipped with a fan or other type of suitable device that is used to draw ambient air into the air inlet system. Representative fans are those centrifugal or squirrel cage types of fans; and representative types of fans are available as Aero Series 39MW30 from Carrier Corporation, Farmington, Conn. Typically, the fan is operated so as to provide movement of air through the air inlet system at a rate of about 7500 CFM to about 15,000 CFM (at 4 inch wc static pressure). As an example, air is drawn through the duct work at a rate of about 1,000 CFM (at 4 inch wc static pressure). As such, for ambient air at common relative humidity, the incoming moist ambient air introduces about 75 to about 80 pounds of water per hour into the duct work.

Downstream from the fan is positioned an optional mesh screen or filter. Such screen or filter is generally of the type previously described. If desired, a screen or filter can be positioned on each side of the fan. If desired, a single screen or filter can be positioned upstream from the fan, or a single screen or filter can be positioned downstream from the fan. Most preferably, at least one screen or filter employed.

Within the duct work downstream from the fan is positioned at least one cooling coil, or other means for removing moisture from the ambient air that is passing through the duct work to the air inlet region of the barn. For example, a cooling coil available as Aero Series 39MW30 Direct Expansion Cooling Coil from Carrier Corporation can be positioned within the duct work. Such cooling coil is operated so that, for example, at least about 40 pounds of water can be removed per hour from an ambient airstream of about 1,000 CFM. The water condensed by the cooling coil can be removed from the air inlet system through a drain, collected in a container, or the like.

The airstream that has had a portion of its moisture removed then is introduced into secondary drying system. For example, the airstream is passed through a dehumidifying type of device, such as a Munters Honeycomb Dessicant Wheel DeHumidifier Model DryCool ERV-1440 that is obtained from Munters Corporation. As such, about 34 pounds per hour of water can be removed from that airstream. As such, the airstream that exits the air inlet region of the secondary drying system is very dry. That dry air then is directed through duct work into the air inlet region of the barn.

The dry air that enters the air inlet region of the barn typically has an airflow rate that is somewhat reduced relative to that of the airflow that enters the air inlet system. For example, the air that enters the air inlet region of the barn can have an airflow rate of about 825 CFM (for an initial airflow rate of 1,000 CFM that enters the air inlet system). In addition, greater than 99 percent of the water that was present in the ambient air entering the air inlet system is removed from that ambient air. Thus, given that the inlet air is very dry, virtually all of the water and other tobacco extractables that are collected using the liquid recovery system is that has been removed from the tobacco during the curing process.

The exhaust system of the barn is equipped with duct work. The duct work is equipped with a filter (e.g., a filter that can be characterized as a filter that is flat, bag-type, cartridge or high efficiency particulate (HEPA)).

The moist air exiting the barn through the duct work then passes through a direct expansion type of cooling coil of type operating in a traditional manner so as to provide for condensation of vapor in the surrounding atmosphere; and as such about 140 pounds per hour of liquid tobacco extract can be condensed and collected.

A booster fan, such as an Aero Series 39MW30 from Carrier Corporation, is located near the extreme outlet end of the duct work. The moist air exiting the barn through the duct work then passes through a cooling coil of Aero Series 39MW30 Direct Expansion cooling Coil such about 140 pounds per hour of liquid tobacco extract can be condensed and collected. Then, the moist air is passed through a dehumidifier, such as a Munters Honeycomb Dessicant Wheel DeHumidifier Model DryCool ERV-1440. As such, an additional 28 pounds per hour of liquid tobacco extract can be condensed and collected. The air exiting the barn then is exhausted to the environment. The collected liquid tobacco extract samples then are combined.

Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment of the invention.

We claim:

1. A system for curing tobacco and for collecting tobacco-derived moisture from tobacco while that tobacco is curing, the system comprising:

a tobacco curing enclosure including a curing chamber; and at least one reclamation element located outside the enclosure and configured to condense and collect moisture released from tobacco cured within the curing chamber;

each reclamation element being disposed in proximity with, but external of, the enclosure in a manner and location providing for passage of moist air released from the tobacco within the curing chamber exiting via duct work out of the enclosure and across a surface of each such reclamation element;

wherein the tobacco curing enclosure comprises a heat generation unit external of the curing chamber, including a heat exchanger, configured to heat air from outside the enclosure to be directed through the curing chamber, and thereby heat tobacco positioned within that curing chamber; and at least one storage container disposed in fluid communication with each reclamation element, the at least one container being configured to store moisture and moisture-borne material collected from each reclamation element;

wherein a primary airflow path of the system is defined in order by steps comprising: air passing through a first means for removing moisture from the air; entering the enclosure; being heated during passage through the heat generation unit; entering, passing through, and exiting the curing chamber; passing through the at least one reclamation element; and thereafter exhausting into an environment external to the system.

2. The system of claim 1, further comprising a second means for removing moisture from the air before the air enters the curing chamber.

3. The system of claim 1, further comprising at least one air-directing means configured to circulate air across the at least one reclamation element.

4. The system of claim 3, further comprising at least one passage that recirculates air from the at least one reclamation element back into the curing chamber along a secondary airflow path.

5. The system of claim 1, wherein each reclamation element comprises a surface configured to be cooled to a moisture-condensing relative temperature.

6. A tobacco curing barn comprising:

a curing region to position harvested tobacco leaves to be cured;

means external of the curing region for removing moisture from air entering the curing region from an environment external of the tobacco curing barn;

a heat generation region, including a heat exchange unit, configured to provide heat for curing the tobacco;

a fan configured to circulate heated air within the barn;

a water reclamation system, outside of the curing region and external to the barn, through which air exiting the barn passes to be exhausted external of the barn, where the water reclamation system includes:

at least one reclamation element configured to condense and collect moisture released from the harvested tobacco during curing;

at least one container; and a path of fluid communication for moisture and moisture-borne material from the at least one reclamation element to the at least one container.

7. The tobacco curing barn of claim 6, wherein each reclamation element comprises a cooling element.

8. The tobacco curing barn of claim 6, wherein each means external of the curing region for removing moisture from air entering the curing region is disposed external of the curing barn.

9. The tobacco curing barn of claim 6, wherein the barn comprises at least one vent opening, and wherein each reclamation element is disposed in or immediately adjacent a vent opening.

10. The tobacco curing barn of claim 6, wherein the heat generation region comprises a furnace, and wherein at least one reclamation element is disposed adjacent the furnace.

11. The tobacco curing barn of claim 6, wherein the heat generation region is separated from a curing region.

12. The tobacco curing barn of claim 11, wherein at least one reclamation element is disposed in the heat generation region.

13. The tobacco curing barn of claim 11, wherein at least one reclamation element is disposed adjacent the heat generation region.

14. A system for curing tobacco and for collecting tobacco-derived moisture from tobacco while that tobacco is curing, the system comprising:

a tobacco curing barn including a curing chamber;

a heating system;

at least one air intake fan directing air into the curing chamber from outside of the tobacco curing barn via a moisture-removing means configured to remove moisture from incoming air;

at least one air exhaust fan that exhausts air to an environment outside of the tobacco curing barn; and at least one reclamation element located outside the curing barn where the reclamation element includes at least one cooling element, at least one condenser element, or both together, said cooling and/or condenser element being configured to condense and collect moisture released from tobacco cured within the curing chamber;

each reclamation element being disposed in proximity with the at least one air exhaust fan in a manner and location providing for passage of moist air released from the tobacco within the curing chamber which air, exiting the barn to the environment outside, passes across a surface of each cooling and/or condenser element; and at least one enclosed storage container disposed in fluid communication with each reclamation element, the at least one enclosed storage container being configured to store moisture and moisture-borne material collected from each reclamation element.

15. The system of claim 14, further comprising at least one filter or mesh screen disposed upstream of the at least one air intake fan, downstream of the at least one air exhaust fan, or in both of said locations.

16. The system of claim 14, further comprising at least one duct directing generally dry air, from which moisture has been removed by the reclamation element, from at least one air exhaust fan toward the at least one air intake fan.

17. The system of claim 16, where the at least one duct includes a filter.

18. The system of claim 14, where an air path through the reclamation element comprises a coiled cooling element and a dehumidifier condenser element.

19. The system of claim 14, further comprising an inlet air drying system located exterior of the curing barn, comprising one or both of a cooling element and a dehumidifier condenser element, where the inlet air drying system provides generally dry air to the at least one air intake fan.

* * * * *